United States Patent [19]

Nazmy et al.

[11] Patent Number: 4,612,062

[45] Date of Patent: Sep. 16, 1986

[54] PROCESS FOR PRODUCING A FINE-GRAINED WORKPIECE FROM A NICKEL-BASED SUPERALLOY

[75] Inventors: Mohamed Y. Nazmy, Gebenstorf; Hans Rydstad; Günther Schröder, both of Birmenstorf; Robert Singer, Baden, all of Switzerland

[73] Assignee: BBC Brown, Boveri & Company, Ltd., Baden, Switzerland

[21] Appl. No.: 655,551

[22] Filed: Sep. 28, 1984

[30] Foreign Application Priority Data

Sep. 28, 1983 [CH] Switzerland ..... 5252/83

[51] Int. Cl.[4] ..... C22F 1/10

[52] U.S. Cl. ..... 148/11.5 N

[58] Field of Search ..... 148/11.5 N, 2

[56] References Cited

FOREIGN PATENT DOCUMENTS 1253861 11/1971 United Kingdom .

*Primary Examiner*—R. Dean

*Attorney, Agent, or Firm*—Oblon, Fisher, Spivak, McClelland & Maier

[57] ABSTRACT

A fine-grained workpiece having improved mechanical properties is produced from a nickel-based superalloy by two-part forging, a blank being converted, in a first isothermal hot-forming step (curve b) above the solution-annealing temperature for the $\gamma'$-phase (line a), into an intermediate form and the latter then being finally forged to give the end form in a second isothermal hot-forming step (curve c) just below the solution-annealing temperature for the $\gamma'$-phase. For the first step, a degree of deformation $\epsilon$ of of at least 0.7 at a mean deformation rate $\dot{\epsilon}$ of about $10\times10^{-3}s^{-1}$ is required here. The second step is carried out at deformation rates $\dot{\epsilon}$ which are one to two powers of 10 lower than those of the first step.

6 Claims, 2 Drawing Figures

PROCESS FOR PRODUCING A FINE-GRAINED WORKPIECE FROM A NICKEL-BASED SUPERALLOY

The invention starts from a process for producing a workpiece, in accordance with the generic type of the preamble of claim 1.

From the literature, processes are known, according to which a fine-grained end product can be produced in several working steps, starting from a blank of a heat-resisting alloy (for example a nickel superalloy). This applies in particular to a process in which, in the first step, the starting material is deformed just below its recrystallisation temperature in the conventional manner, so that the desired fine-grained structure is obtained in an intermediate product. In the second step, this intermediate product is then converted into the end product by quasi-isothermal forging with the use of heated dies (British Patent Specification No. 1,253,861).

When carrying out these processes, it is found that it is extremely difficult to obtain an optimum structure for the end product with the best mechanical properties by deformation below the recrystallisation temperature. Moreover, these processes are extraordinarily slow, which has an unfavourable effect on the economics. There is therefore a need to improve the known processes.

It is the object of the invention to indicate a forming process which enables a workpiece to be produced from a nickel-based superalloy, starting from a solution-annealed coarse-grained blank, the end product having at the same time the definitive forged shape, a fine-grained structure and the best possible mechanical properties.

According to the invention, this object is achieved by the features of claim 1.

Figure 1:
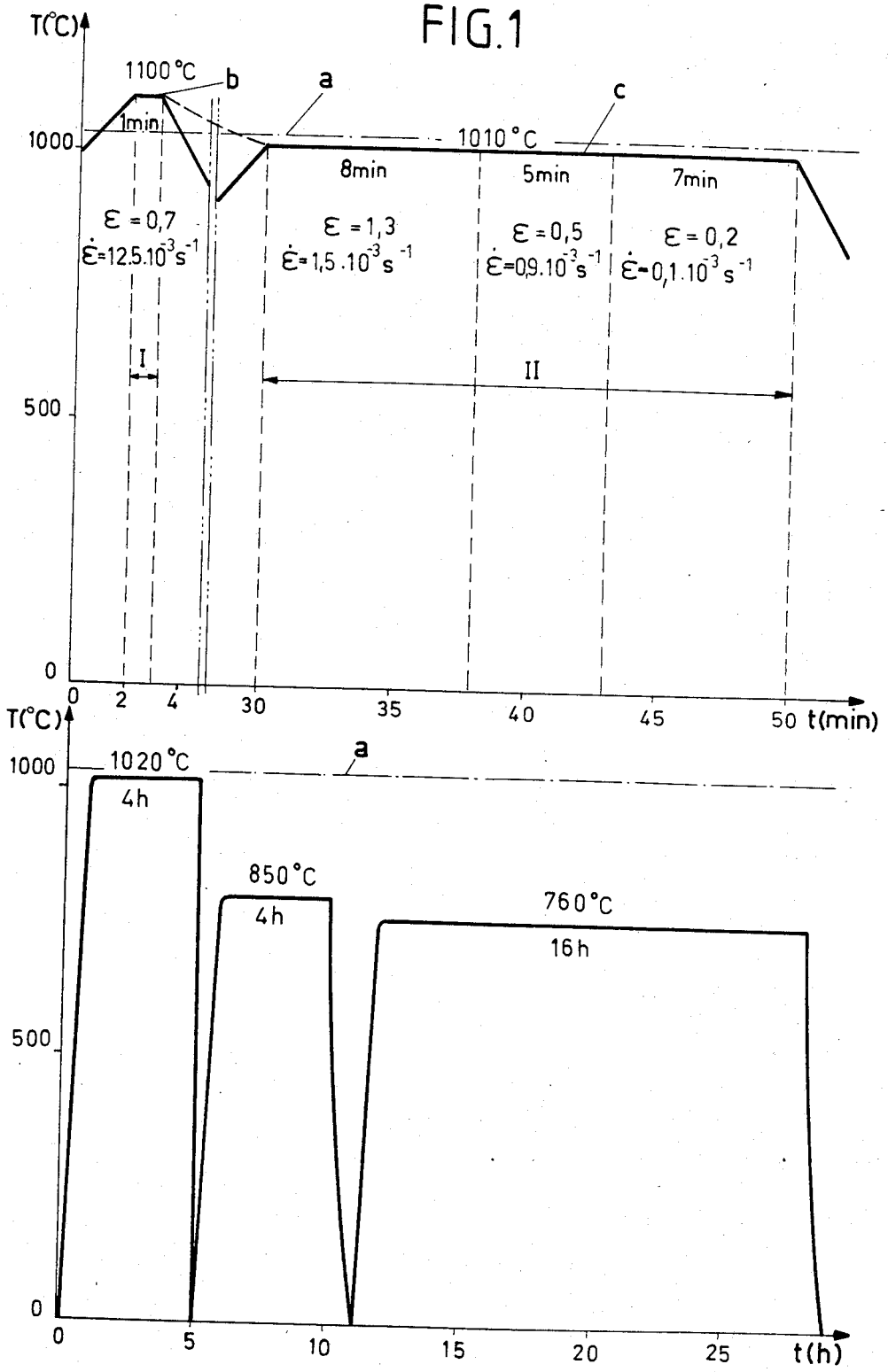
Figure 2:
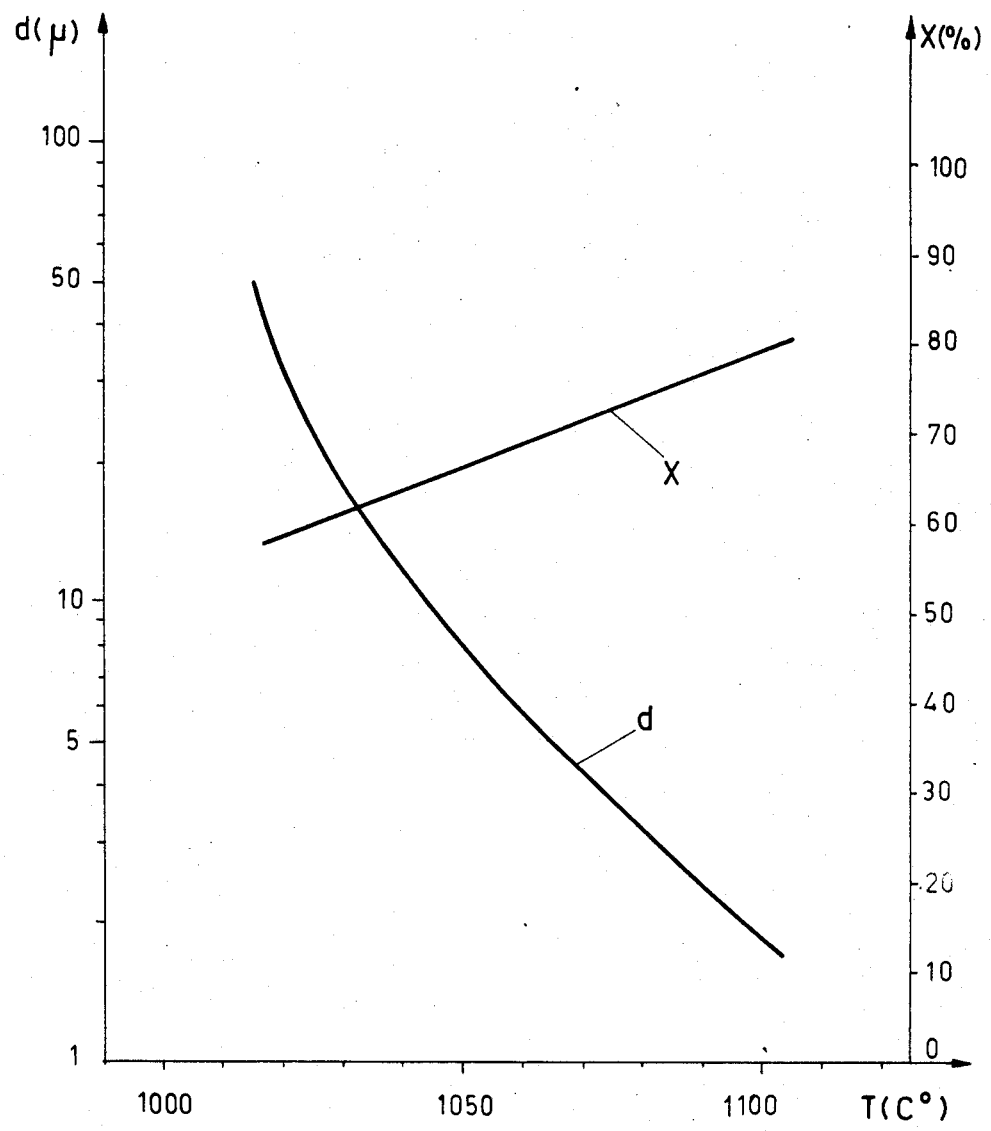

The invention is described by reference to the following illustrative embodiment which is explained by figures in which:

FIG. 1 shows a diagram of the temperature curve of the process as a function of time, and FIG. 2 shows a diagram of the grain size and the coarsegrain fraction as a function of the forming temperature.

In FIG. 1, the temperature curve of the process is shown as a function of time (on an arbitrary, interrupted scale) in the various process steps. For a given material, a is the applicable solution-annealing temperature for the $\gamma'$-phase and, for the superalloy investigated (trade name "Waspaloy"), this is between 1,020° and 1,040° C. (at 1,030° C. on average). The curve b, corresponding to phase I, relates to a first hot-forming step, serving essentially for grain refinement and consisting of isothermal forging (upsetting). The curve c corresponding to phase II represents the second forming step which is carried out substantially slower and leads both to the final form (finished component) and to an increase in the mechanical strength.

The lower part of the Figure shows, on a different timescale, the further heat treatment which is conventional for this class of superalloys, consists of solution-annealing, quenching and repeated precipitation-hardening, and follows the forming process.

FIG. 2 shows in principle the relationships between the formation of the structure and the forming temperature. d represents the mean grain size, and x represents the fraction of coarse individual grains as a function of the forming temperature for constant deformation and deformation rate.

Illustrative embodiment

See FIG. 1.

For producing a double-conical, rotationally symmetrical hollow body with an intermediate flange, a blank of a solution-annealed nickel-based superalloy was used. The alloy, with the trade name "Waspaloy", had the following composition:

C=0.03% by weight
Cr=19.5% by weight
Mo=4.5% by weight
Co=14.0% by weight
Ti=3.0% by weight
Al=1.4% by weight
Fe=2.0% by weight
Ni=Remainder The blank had a cylindrical shape and the following dimensions:

Diameter:1 60 mm
Height:136.5 mm

In the first process step (Phase I), it was upset in a forging press in the axial direction by isothermal forging at a temperature of 1,100° C., which was above the solution-annealing temperature for the $\gamma'$-phase of the material, in such a way that it then had the following dimensions:

Diameter:92 mm
Height:67.2 mm

This corresponded to a degree of deformation $\epsilon$ of 0.7. The mean deformation rate was $\dot{\epsilon}=12.5\times10^{-3}s^{-1}$. $\dot{\epsilon}$ was here defined as follows:

$$\dot{\epsilon}=\frac{d\left[\left|\ln\frac{A_o}{A_f}\right|\right]}{dt},$$

$A_o$=Cross-sectional area of the workpiece before forming, for each step,
$A_f$=Cross-sectional area of the workpiece after forming,
ln=Natural logarithm
t=Time in seconds After the upsetting process, taking about one minute according to Phase I, the workpiece was cooled in air to room temperature.

In the second process step (Phase II), the preformed workpiece was isothermally forged to the finished form in the forging die at a lower temperature, which was just below the solution-annealing temperature of the $\gamma'$-phase. In the present case, this forging temperature was 1,010° C. During Phase II, the deformation rate was lowered in steps, corresponding to the degree of deformation already reached. The degree of deformation $\epsilon$, corresponding to the first stage lasting about eight minutes, was 1.3. The mean deformation rate was $\dot{\epsilon}=1.5\times10^{-3}s^{-1}$, which corresponded to an average ram speed of about 0.1 mm/s. The maximum press force reached was 1,800 kN. The second stage lasting about five minutes corresponded to a degree of deformation $\epsilon$ of 0.5 at a deformation rate of $\dot{\epsilon}=0.9\times10^{-3}s^{-1}$. The third stage, lasting about seven minutes, still reached an $\epsilon$ of 0.2 at $\dot{\epsilon}=0.1\times10^{-3}s^{-1}$. In this case, the maximum press force reached was 2,000 kN. All the $\epsilon$ and $\dot{\epsilon}$ are relative to the $A_o$ of the second process step.

After the final forging according to Phase II, the workpiece was subjected to the usual conventional heat treatment: solution annealing at 1,020° C. for four hours, quenching in oil, annealing at 850° C. for four hours, cooling in air, precipitation-hardening at 750° C. for sixteen hours, and cooling in air.

The finished forged and heat-treated workpiece had a yield strength of 938 Mpa at room temperature, while the elongation was 22%.

The process is not restricted to the illustrative embodiment. For example, the air cooling after Phase I can be omitted under certain circumstances. Forging would thus take place at one heat, as is indicated by the dashed curve between the branches b and c in FIG. 1. The process can then also be arranged in such a way that the first step essentially consists of upsetting the forging blank in the die with subsequent cooling in the die to the forging temperature of the second step. The basis of a further possible variant is that the first step consists of pre-upsetting of the forging blank with subsequent precision forging in the die at a temperature above the solution-annealing temperature for the $\gamma'$-phase of the material. Moreover, when passing from the first to the second step (between Phase I and Phase II), the workpiece can be cooled with simultaneous application of a load.

In addition to "Waspaloy", quite a number of other superalloys are also suitable for the process, examples being those of the trade names Astroloy, Alloy 901, IN 718, IN 100, René 95 and the like. Generally, the alloy limits can be stated approximately as follows:

C=0.02 to 1.00% by weight
Cr=13 to 22% by weight
Mo=3 to 6% by weight
Ti=0.8 to 3.5% by weight
Nb=0 to 6% by weight
Al=0.3 to 4.0% by weight
Co=0 to 20% by weight
Fe=0 to 20% by weight
Ni=Remainder During the first process step (Phase I), the degree of deformation $\epsilon$ should at least reach the value 0.7, at deformation rates $\dot{\epsilon}$ which advantageously are between $5\times10^{-3}s^{-1}$ and $15\times10^{-3}s^{-1}$ (on average about $10\times10^{-3}s^{-1}$). In the second process step (Phase II), the degree of deformation must reach a value which is sufficient for obtaining the desired good mechanical properties. This value depends on the shape and size of the workpiece. The corresponding deformation rates $\dot{\epsilon}$ are here approximately in the range between $2\times10^{-3}s^{-1}$ and $0.1\times10^{-3}s^{-1}$. They decrease with increasing degree of deformation $\epsilon$, to the extent at which the workpiece approaches the final form.

It is essential that the first step is carried out above the solution-annealing temperature for the $\gamma'$-phase of the material and the second step is carried out just below this temperature, so that, for the final form, a mean grain size of 4 to 40 μm, a hot yield point of at least 780 Mpa at 540° C. and a life of at least 100 hours (creep strength) under a load of 510 Mpa at 670° C. are obtained.

We claim:

1. Process for producing a fine-grained workpiece, having improved mechanical properties, from a nickel-based suoeralloy, characterised in that, in a first step, a forging blank is converted into an intermediate form by isothermal forging above the solution-annealing temperature for the $\gamma'$-phase, a degree of deformation $\epsilon$ of at least 0.7 and a deformation rate $\dot{\epsilon}$ of $5\times10^{-3}s^{-1}$ to $15\times10^{-3}s^{-1}$ being maintained, and that the intermediate form is, in a second step, converted into the final form by isothermal forging just below the solution-annealing temperature for the $\gamma'$-phase, using a deformation rate $\dot{\epsilon}$ of $2\times10^{-3}s^{-1}$ to $0.1\times10^{-3}s^{-1}$, $\dot{\epsilon}$ being defined as follows:

$$\dot{\epsilon} = \frac{d\left[\left|\ln\frac{A_o}{A_f}\right|\right]}{dt},$$

$A_o$=Cross-sectional area of the workpiece before forming, for each step,
$A_f$=Cross-sectional area of the workpiece after forming,
ln=Natural logarithm
t=Time in seconds.

2. Process according to claim 1, characterised in that the workpiece is forged to give a final form having a mean grain size of 4–40 μm, a hot yield point of at least 780 Mpa at 540° C. and a life of at least 100 hours under a load of 510 Mpa at 670° C.

3. Process according to claim 1, characterised in that the nickel-based superalloy has a composition within the following limit values:

C=0.02 to 1.00% by weight
Cr=13 to 22% by weight
Mo=3 to 6% by weight
Ti=0.8 to 3.5% by weight
Nb=0 to 6% by weight
Al=0.3 to 4.0% by weight
Co=0 to 20% by weight
Fe=0 to 20% by weight
Ni=Remainder 4. Process according to claim 1, characterised in that the first step consists essentially of upsetting the forging blank in the die, with subsequent cooling in the die to the forging temperature of the second step.

5. Process according to claim 1, characterised in that the first step consists of pre-upsetting of the forging blank with subsequent precision-forging in the die at a temperature above the solution-annealing temperature of the material.

6. Process according to claim 1, characterised in that cooling of the workpiece, when passing from the first to the second step, is carried out with simultaneous application of a load.

* * * * *